US009194158B2

(12) United States Patent
Lai

(10) Patent No.: US 9,194,158 B2
(45) Date of Patent: Nov. 24, 2015

(54) ANTI-ZIPPER PULLER SLIDING DEVICE

(71) Applicant: The Sun Lock Company, Ltd., Tuen Mun, N.T. (HK)

(72) Inventor: Karl Lai, Hong Kong (HK)

(73) Assignee: THE SUN LOCK COMPANY LTD., Tuen Mun, NT (HK)

( * ) Notice: Subject to any disclaimer, the term of this patent is extended or adjusted under 35 U.S.C. 154(b) by 361 days.

(21) Appl. No.: 13/775,370

(22) Filed: Feb. 25, 2013

(65) Prior Publication Data

US 2014/0060988 A1 Mar. 6, 2014

Related U.S. Application Data

(60) Provisional application No. 61/696,556, filed on Sep. 4, 2012.

(51) Int. Cl.

| | |
|---|---|
| ***E05B 67/38*** | (2006.01) |
| ***E05B 65/52*** | (2006.01) |
| ***A45C 5/00*** | (2006.01) |
| ***A44B 19/30*** | (2006.01) |
| ***A45C 13/10*** | (2006.01) |
| ***A45C 13/18*** | (2006.01) |

(52) U.S. Cl.

CPC ..... *E05B 65/52* (2013.01); *A44B 19/30* (2013.01); *A45C 5/00* (2013.01); *A45C 13/103* (2013.01); *A45C 13/18* (2013.01); *Y10T 70/5053* (2015.04)

(58) Field of Classification Search

CPC . E05B 65/52; E05B 65/5207; E05B 65/5215; E05B 65/5223; E05B 65/523; E05B 65/5238; E05B 65/5284; A44B 19/30; A44B 19/301; A44B 19/303; A44B 19/305; A44B 19/306; A44B 19/308

USPC ..... 70/68–76, 21

See application file for complete search history.

(56) References Cited

U.S. PATENT DOCUMENTS

| | | | | |
|---|---|---|---|---|
| 3,319,743 | A * | 5/1967 | Pelavin et al. | 70/68 |
| 3,965,706 | A * | 6/1976 | Davis | 70/68 |
| 3,978,697 | A | 9/1976 | Bako | |
| 4,756,173 | A * | 7/1988 | Yang | 70/68 |
| 4,884,419 | A * | 12/1989 | Ling | 70/68 |
| 5,136,864 | A * | 8/1992 | Spiekermann et al. | 70/68 |
| 6,308,541 | B1 | 10/2001 | Stowe | |
| 7,516,523 | B2 * | 4/2009 | Okot | 24/385 |
| 7,779,657 | B2 * | 8/2010 | Yu | 70/21 |
| 2003/0066170 | A1 * | 4/2003 | Huang | 24/387 |
| 2004/0237605 | A1 * | 12/2004 | Lin et al. | 70/68 |

FOREIGN PATENT DOCUMENTS

| | | |
|---|---|---|
| GB | 1037791 | 8/1966 |
| JP | 2000320215 A | 11/2000 |
| WO | 20100105297 A1 | 9/2010 |

* cited by examiner

*Primary Examiner* — Christopher Boswell

(74) *Attorney, Agent, or Firm* — Ware, Fressola, Maguire & Barber LLP

(57) ABSTRACT

The present invention is directed to embodiments of an anti-zipper sliding device that may include at least one body, a gripping surface affixed onto the body, a fastener to removably attach the body and the gripping surface onto a piece of luggage having a zipper with a zipper track and a zipper puller so as to prevent the anti-zipper sliding device from moving along the zipper track of the luggage. The anti-zipper sliding device may also include at least one locking mechanism or be configured for engagement with at least one locking mechanism in order to lock at least one zipper puller to the anti-zipper sliding device in order to prevent the zipper from being re-zipped after a zipper breach.

20 Claims, 7 Drawing Sheets

ANTI-ZIPPER PULLER SLIDING DEVICE

CROSS-REFERENCE TO RELATED APPLICATIONS

This application claims priority to U.S. Provisional Appl. No. 61/696,556 filed Sep. 4, 2012, which is hereby incorporated by reference in its entirety.

BACKGROUND OF THE INVENTION

1. Field of the Invention

The present invention relates to a device for making a zipper breach evident, and more particularly a device for making a zipper breach in luggage evident.

2. Description of Related Art

There are many types of baggage locks which are used to lock together the zipper pullers on luggage, thereby preventing the zipper from being opened by unauthorized personnel. Many of these locks are approved by the Transportation Security Administration (TSA) and have means for allowing a master key to open the locks by TSA approved personnel.

However, a luggage zipper can be easily breached by use of a pointed article, such as a ball point pen. The term "zipper breach" in this application means the use of a sharp pointed item, such as a needle, ball point pen, or screw driver, to break into (open) the zipper track so as to break into a piece of luggage. Furthermore, the luggage zipper can be re-zipped by simply sliding the lock with the zipper pullers locked thereto around the path of the zipper, thereby re-zipping the luggage. When re-zipped, there is no visible evidence that the luggage has, in fact, been breached. Such breaching of luggage where no evidence is left that the luggage was breached, is a significant security threat since items could be placed in a piece of luggage without knowledge of the owner of the luggage, even though the luggage zipper is locked with a TSA approved luggage lock.

As noted above, once there is a zipper breach, a person can slide the zipper pullers attached to a lock (usually the zipper pullers are locked by a padlock) to seal the gap of the zipper (i.e., re-zip the zipper) so that the luggage appears as if it had not been breached. This means that an unauthorized person can steal items from a locked piece of luggage within seconds; yet, the lock is not being tampered with nor is there evidence of the zipper breach. This is a serious problem which can make the owner of the luggage feel unsafe, especially, when there are valuable items placed in luggage. Such theft of items would typically not be noticed until the luggage lock is unlocked and the luggage opened. Furthermore, such a zipper breach could be used by a terrorist or smuggler to insert some type of contraband into the luggage. Therefore, there is a need to restrict the movement of the zippers so that the gap of the zipper cannot be resealed once there has been an unauthorized zipper breach.

SUMMARY OF THE INVENTION

The present invention is designed to overcome the above noted limitations that are attendant upon the use of conventional luggage locks and, toward this end, it contemplates the provision of a novel an anti-zipper puller sliding device which prevents a breach of a luggage zipper from being concealed by re-zipping the zipper even when a luggage lock is affixed to the zipper pullers.

The anti-zipper sliding device may include at least one body; a gripping surface affixed onto the body a fastener to removably attach the body and the gripping surface onto a piece of luggage having a zipper with a zipper track and a zipper puller so as to prevent the device from moving relative to the luggage; and means for attaching the device to a padlock so as to lock the zipper puller to the device thereby preventing the zipper from being re-zipped after a zipper breach.

Accordingly, it is an object of the present invention to provide an anti-zipper puller sliding device that restricts an unauthorized person from being able to slide zipper pullers of a zipper track back and forth to seal a breached zipper track.

It is another object of the present invention to provide a mechanism so that a zipper breach is evident since the luggage zipper cannot be re-zipped, and leaving the luggage will therefore be left with a gap (i.e., un-zipped), which will alert everyone that the luggage has been breached.

It is yet another object of the present invention to alert a luggage inspector, such as a TSA officer, that the luggage has been opened suspiciously. The luggage can then be inspected and its owner contacted to determine if any items have been stolen.

It is still another object of the present invention to make a zipper breach evident.

An exemplary embodiment of the present invention is directed to an anti-zipper sliding device that may include a first body portion and a second body portion configured for removable attachment to each other by a fastener, at least one gripping surface positioned on at least one of the first body portion or the second body portion, and a cover configured to cover at least a part of the first body portion and at least a part of the fastener.

In accordance with the exemplary embodiment of the present invention, the first body portion and the second body portion are configured for attachment to a piece of luggage having a zipper track with at least one zipper so as to prevent movement of the anti-zipper sliding device along the zipper track of the luggage, and the cover is further configured to be secured to the first body portion by a locking mechanism when the cover covers at least a part of the first body portion.

In accordance with the exemplary embodiment of the present invention, the anti-zipper sliding device may also include the fastener, and he fastener is configured to position the anti-zipper sliding device between a clamped mode in which movement of the anti-zipper sliding device along the zipper track of the luggage is prevented, and a separated mode in which the anti-zipper sliding device is disengaged from the luggage or slidable along the zipper track of the luggage.

In accordance with the exemplary embodiment of the present invention, when the anti-zipper sliding device is in the clamped mode the at least one gripping surface is engaged with at least a portion of the zipper track, and the at least one gripping surface and the zipper track are positioned between the first body portion and the second body portion.

In accordance with the exemplary embodiment of the present invention, the anti-zipper sliding device may also include at least one locking post extending from the second body portion, and at least one post receiving chamber formed in the first body portion, and each of the at least one post receiving chambers are positioned in the first body portion to at least partially receive one of the at least one locking post when the anti-zipper sliding device is in the clamped mode.

In accordance with the exemplary embodiment of the present invention, when the at least one locking post is received within one of the at least one post receiving chambers, the at least one locking post is configured to secure to one of the at least one zippers of the zipper track so that when the anti-zipper sliding device is in the clamped mode movement of the zipper relative to the anti-zipper sliding device is restricted.

In accordance with the exemplary embodiment of the present invention, the first body portion may include a fastener hole configured to receive the fastener to allow the fastener to pass through the first body portion, and the second body portion may include a threaded hole configured for alignment with the fastener hole when the anti-zipper sliding device is in the clamped mode and configured to threadenly engage with the fastener in order to secure the first body portion to the second body portion.

In accordance with the exemplary embodiment of the present invention, where at least one gripping surface is positioned on the first body portion and at least one gripping surface is positioned on the second body portion so that each of the at least one gripping surfaces substantially face each and are engaged with the zipper track when the anti-zipper sliding device is in the clamped mode.

In accordance with the exemplary embodiment of the present invention, the first body portion may include a locking extension and a hole formed therein, and the cover comprises an extended tab and a tab hole formed therein and dimensioned to receive the locking extension of the first body portion when the cover covers at least a part of the first body portion.

In accordance with the exemplary embodiment of the present invention, the locking mechanism is a padlock having a shackle, cable or chain, and the padlock is configured to secure the locking extension to one of the at least one zippers by passing the shackle, cable or chain through the hole formed in the locking extension and the zipper so that when the anti-zipper sliding device is in the clamped mode movement of the zipper relative to the anti-zipper sliding device is restricted.

In accordance with the exemplary embodiment of the present invention, when the shackle, cable or chain of the padlock is locked onto the locking extension the cover is secured to the first body portion.

In accordance with the exemplary embodiment of the present invention, the locking mechanism may include a combination locking mechanism operable between a locked configuration and an unlocked configuration, and the cover is releasable from the first body portion when the combination locking mechanism is in the unlocked configuration.

In accordance with the exemplary embodiment of the present invention, the locking mechanism may also include a key locking mechanism operable between a locked orientation and an unlocked orientation, and the cover is releasable from the first body portion when the key locking mechanism is in the unlocked orientation.

In accordance with the exemplary embodiment of the present invention, the anti-zipper sliding device may also include a pair of locking posts extending from the second body portion and positioned at opposite ends of the second body portions, and a pair of post receiving chambers formed in the first body portion, each the pair of post receiving chambers are positioned in the first body portion to at least partially receive one of the pair of locking posts when the anti-zipper sliding device is in the clamped mode.

In accordance with the exemplary embodiment of the present invention, the first body portion may include an extension and a hole formed therein, and the cover may include a shackle hole formed therein and positioned for alignment with the hole when the cover covers at least a part of the first body portion.

In accordance with the exemplary embodiment of the present invention, the locking mechanism is a padlock having securing mechanism such as a shackle, cable or chain, and the padlock is configured to secure the extension to one of the at least one zippers by passing the shackle, cable or chain through the hole formed in the locking extension and the zipper so that when the anti-zipper sliding device is in the clamped mode movement of the zipper relative to the anti-zipper sliding device is restricted.

In accordance with the exemplary embodiment of the present invention, when the shackle, cable or chain of the padlock is locked onto the extension the cover is secured to the first body portion.

In accordance with the exemplary embodiment of the present invention, the anti-zipper sliding device may also include at least one projection extending from the first body portion, and at least one slot formed in the cover and each of the at least one slot are positioned to receive one of the at least one projection when the cover covers at least a part of the first body portion.

In accordance with the exemplary embodiment of the present invention, the second body portion may include a protection ring extending from a surface of the second body opposite a surface from which the at least one gripping member extends from, and the protection ring is configured to protect the fastener from being released from the ant-zipper sliding device when the anti-zipper sliding device is in the clamped mode.

BRIEF DESCRIPTION OF THE DRAWINGS

For a fuller understanding of the nature and objects of the present invention, reference is made to the following detailed description taken in connection with the accompanying drawings in which.

DETAILED DESCRIPTION

Figure 2:
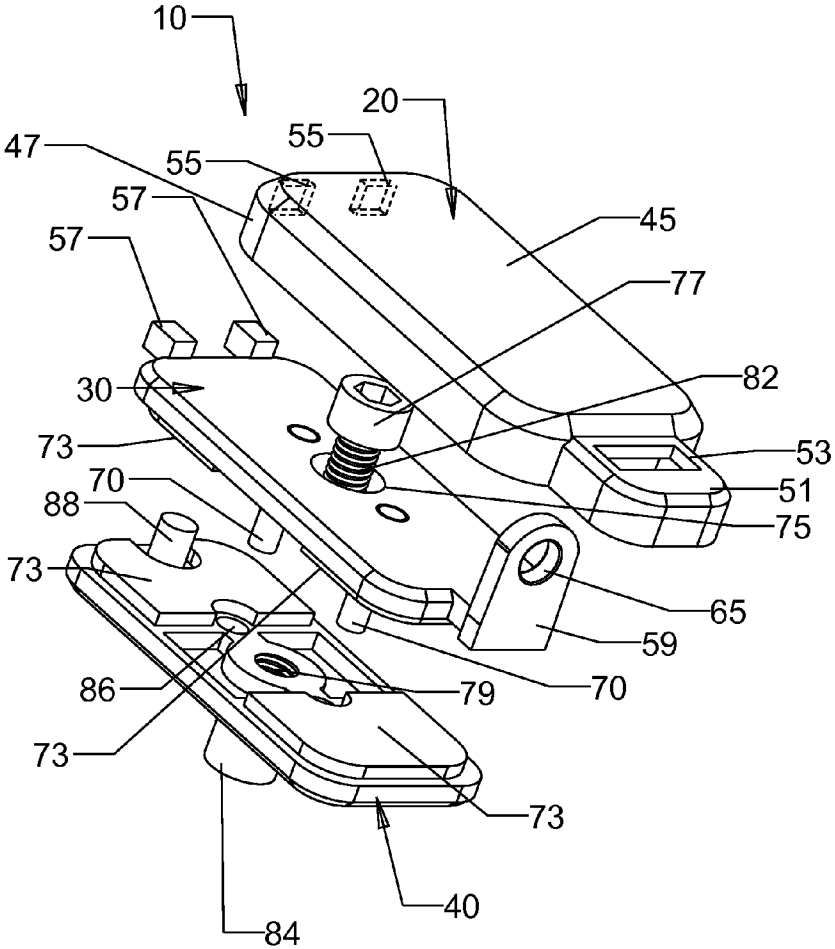
FIG. 2 is a top exploded perspective view of the exemplary embodiment of the anti-zipper sliding device as shown in FIG. 1.

The present invention now will be described more fully hereinafter with reference to the accompanying figures, in which exemplary embodiments of the invention are shown. The invention may, however, be embodied in many different forms and should not be construed as limited to the embodiments set forth herein. Like reference numerals refer to like elements throughout.

Figure 1:
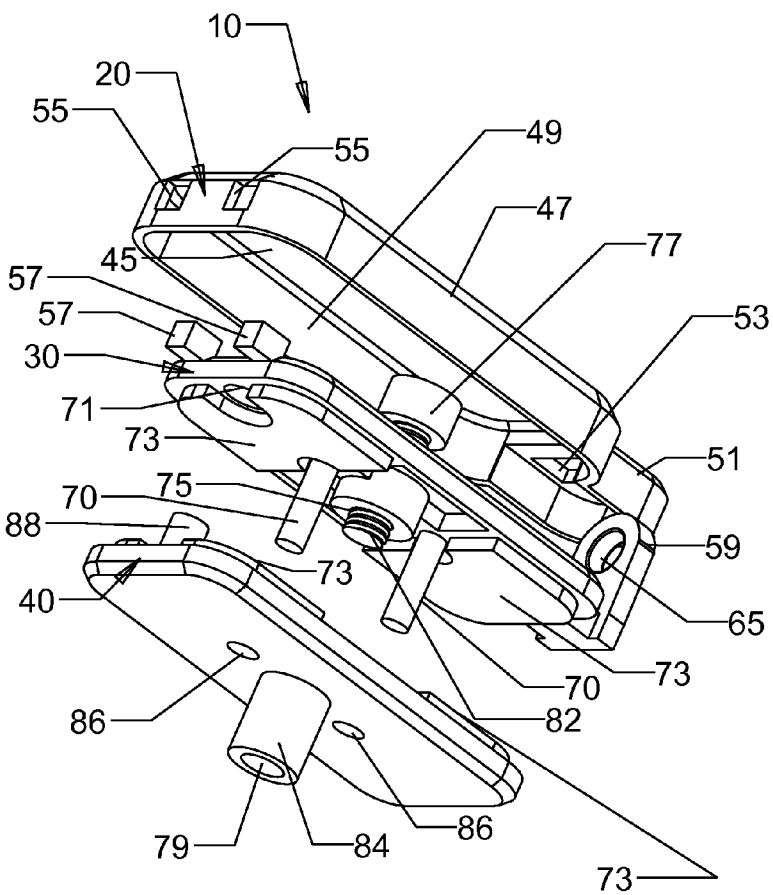
FIG. 1 is a bottom exploded perspective view of an exemplary embodiment of an anti-zipper sliding device according to the present invention.
Figure 3:
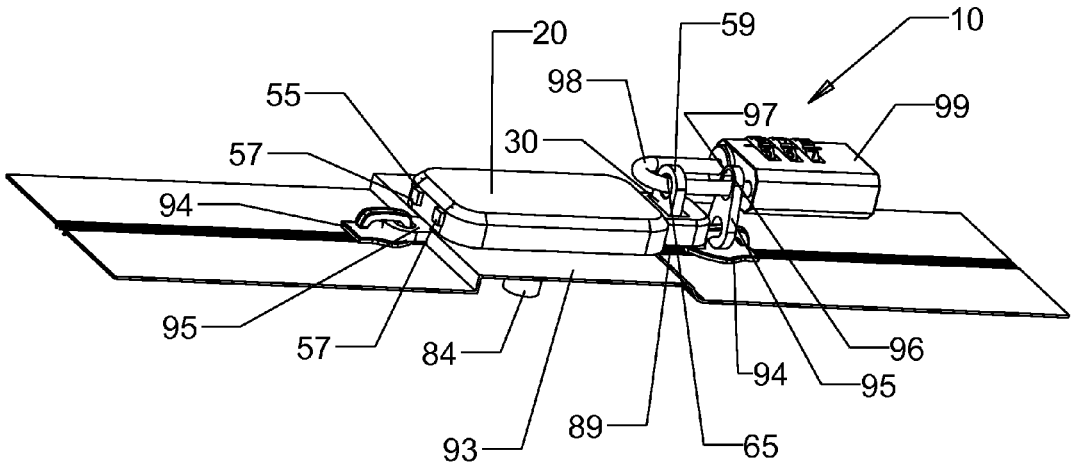
FIG. 3 is a top perspective view of the exemplary embodiment of the anti-zipper sliding device attached around a luggage zipper so as to prevent unauthorized re-zipping of the luggage zipper if there has been a zipper breach.
Figure 4:
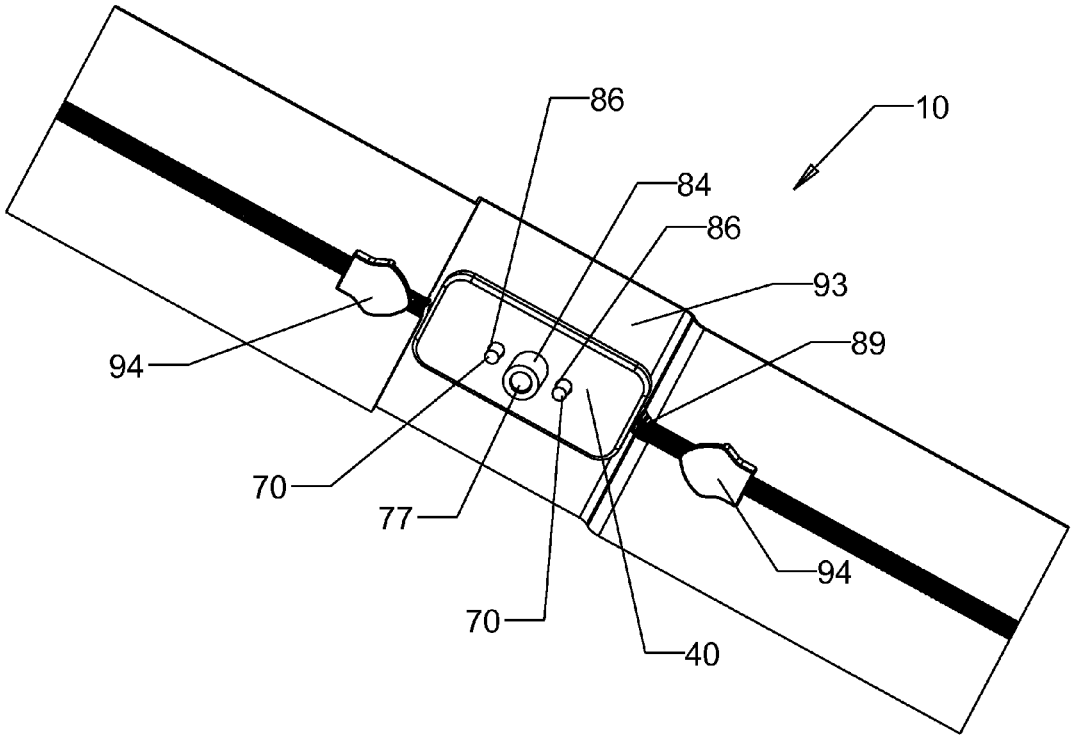
FIG. 4 is a bottom perspective view of the exemplary embodiment of the anti-zipper sliding device as shown from inside of the luggage.
Figure 5:
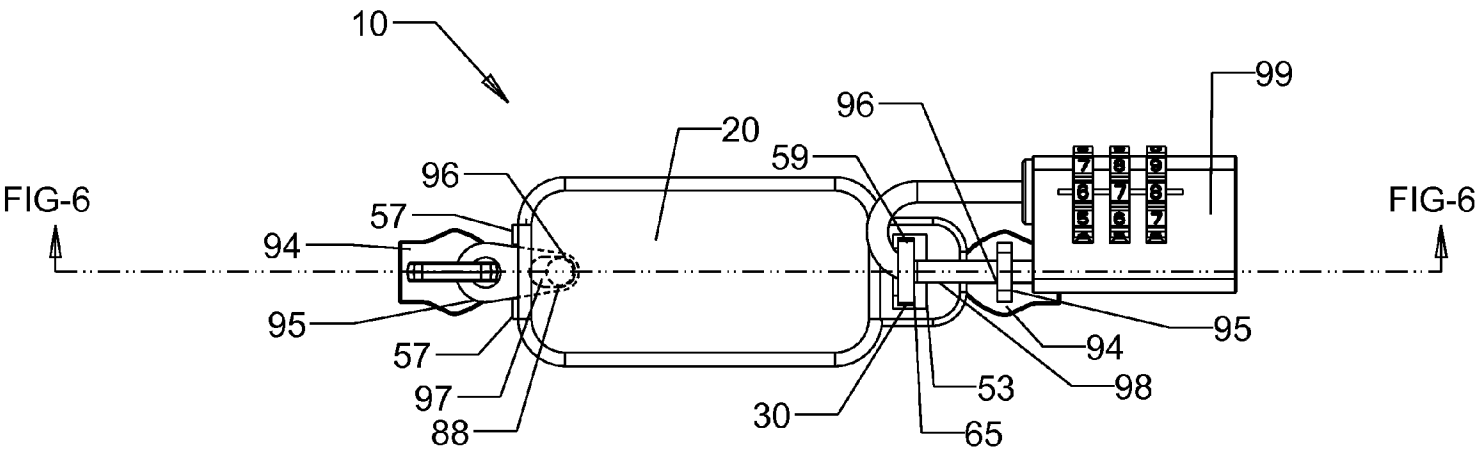
FIG. 5 is a top plan view of the exemplary embodiment of the anti-zipper sliding device according to the present invention attached to zipper pullers.
Figure 6:
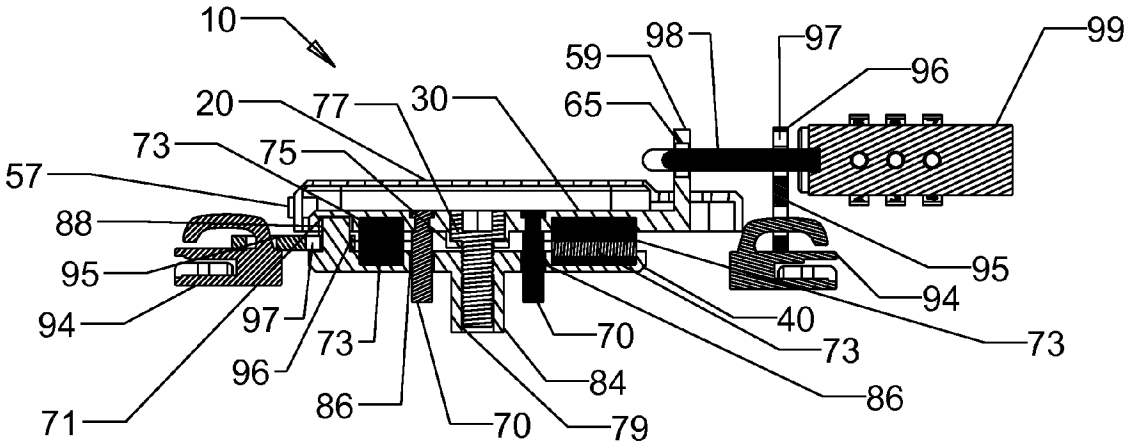
FIG. 6 is a cross-sectional view of the exemplary embodiment of the anti-zipper sliding device according to the present invention taken along line 6-6 in FIG. 5.

Referring now to FIGS. 1-2, in which an exemplary embodiment of an anti-zipper sliding device, generally indicated by reference numeral 10, according to the present invention is shown. The anti-zipper sliding device 10 includes a cover 20, an upper body 30 and a lower body 40. The upper body 30 and the lower body 40 are configured for releaseable engagement with each other, and the cover 20 is dimensioned to at least partially cover the upper body 30. It is understood that the use of the terms "upper" and "lower" to refer to the upper body 30 and the lower 40 are merely used to identify the body portions, and are not intended to limit the location, position and/or orientation of the upper body 30, lower body 40 and/or anti-zipper sliding device 10 in any particular manner. The cover 20 may include a body covering portion 45 that is configured to cover at least a portion of the upper body 30, and the cover 20 may also include a sidewall 47 surrounding at least a part of the perimeter of the body covering portion 45. The body covering portion 45 and the sidewall 47 may form a cavity 49 of the cover 20, in which the upper body 30 may be received. The cover 20 may also include an extended tab 51 that extends from the sidewall 47 at one end of the cover 20. The extended tab 51 may include a hole 53 formed therein, and the cover 20 may also have at least one slot 55 formed in the sidewall 47 at an end of the cover 20 opposite the extended tab 51.

Still referring to FIGS. 1-2, the upper body 30 of the anti-zipper sliding device 10 includes at least one projection 57 extending from one end of the upper body 30 that is configured to be receiving engaged with the at least one slot 55 of the cover 20. It is understood that the upper body 30 may include a number of the projections 57 to correspond to the number of slots 55 formed in the cover 20, for example two, but it is understood that the present invention is not limited to any particular number of projections 57 and/or slots 55. The upper body 30 may also include a locking extension 59 positioned at an end of the upper body 30 opposite the at least one projection 57. The locking extension 59 is positioned and dimensioned to be received by the hole 53 formed in the extended tab 51 of the cover 20. The locking extension 59 may be positioned substantially perpendicular to the upper body 30, and may include a hole 65 formed therein. The upper body 30 may also include at least one alignment pin 70 extending from a surface of the upper body 30, and a post receiving chamber 71 formed in the same surface of the upper body 30 from which the at least one alignment pin 70 extends from. The upper body 30 may also include at least one gripping surface 73 formed on and/or from the same surface of the upper body 30 from which the at least one alignment pin 70 extends from. A screw hole 75 may also be formed in the upper body 30 in order to allow a screw 77, or other fastening device, to partially pass through the upper body 30. It is understood that the upper body 30 may be configured to receive and/or retain multiple fastening devices, such as multiple screws 77.

Still referring to FIGS. 1-2, the lower body 40 of the anti-zipper sliding device 10 may include at least one gripping surface 73 extending from and/or formed on a surface thereof that faces the at least one gripping surface 73 of the upper body 30 when the upper body 30 and the lower body 40 are fastened together. The lower body 40 may also include a threaded hole 79 that is configured to align with the screw hole 75 of the upper body 30 in order to engage with and receive threads 82 on the screw 77. It is understood that the lower body 40 may be configured so as to receive and/or retain multiple screws 77, or other fastening devices. Extending from a surface of the lower body 40 opposite the surface from which the at least one gripping surface 73 extends from is a screw protection ring 84 that extends around the threaded hole 79. The screw protection ring 84 is configured to protect the screw 77 from being unwound from the surface of the lower body 40 opposite the surface from which the at least one gripping surface extends from. The lower body 40 may also include at least one hole 86 that is dimensioned and positioned within the lower body 40 to receive the at least one alignment pin 70 of the upper body 30. The lower body 40 also includes a locking post 88 extending from the lower body 40 on the same side of the lower body 40 as the at least one gripping surface 73, and dimensioned and positioned so as to be at least partially inserted into the post receiving chamber 71 of the upper body 30.

The operation and use of the anti-zipper sliding device 10 according to this exemplary embodiment of the present invention will now be discussed with reference to FIGS. 1-6. As shown for example in FIGS. 3-4, the anti-zipper sliding device 10 may be installed on a zipper track 89 of a piece of luggage 93. The zipper track 89 on the luggage 93 may be separated, i.e. opened, and joined, i.e. closed by at least one zipper 94, and preferably the zipper track 89 includes two zippers 94. Each zipper 94 has a zipper puller 95 that includes a loop 96 that may define a hole 97 of the zipper puller 95. In order to install the anti-zipper sliding device 10 on the zipper track 89 so that movement of the zippers 94 is restricted and/or prevented, the lower body 40 is placed within the luggage 93 and then the locking post 88 is placed into the hole 97 of one of the zipper pullers 95. In order to install the anti-zipper sliding device 10 on the luggage 93, the zipper pullers 95 are operated such that the zippers 94 are moved away from each other in order to allow the lower body 40 to be placed underneath the zipper track 89 of the luggage 93. The upper body 30 is then positioned on the outside of the luggage 93 and engaged with the lower body 40 by aligning the at least one alignment pin 70 with the corresponding at least one hole 86 and inserting the locking post 88 at least partially into the post receiving chamber 71. The screw 77, or other fastening mechanism, may then be inserted through the screw hole 75 of the upper body 30 in order to threadenly engage with the threaded hole 79 of the lower body 40. The screw 77 is then tightened in order to secure the upper body 30 to the lower body 40, and thereby secure both the upper body 30 and the lower boy 40 to a particular position on the zipper track 89 of the luggage 93.

Still referring to FIGS. 1-6, once the upper body 30 and lower body 40 have been secured to the zipper track 89, the cover 20 may be installed on the upper body 30 by placing the at least one projection 57 through the corresponding at least one slot 55 on the cover and inserting the locking extension 59 through the hole 53 formed in the tab 51 of the cover 20. The at least one projection 57 prevents pushing the cover 20 off of the anti-zipper sliding device 10 when the anti-zipper sliding device 10 has been locked and clamped onto the luggage 93. The shape of the at least one slot 55 and the at least one projection 57 do not matter; as long as this function is performed. In this manner, the screw 77 is covered by the cover 20, and therefore can only be accessed by removal of the cover 20. In order to further secure the cover 20 to the upper body 30, and the anti-zipper sliding device 10 to the zipper track 89 a shackle 98 of a padlock 99 may be placed through the hole 65 in the locking extension 59 and the hole 97 of the other zipper puller 95. It is understood that the padlock 99 may be any padlock known to one of ordinary skill in the relevant art, and while a combination locking mechanism type padlock 99 is shown it is understood that any locking mechanism or combination of locking mechanisms, for example a tool locking mechanism, i.e. operated by a tool such as a key, or combination locking mechanism requiring input of a particular combination for operation may be used with the present invention, as the present invention is not limited to any particular type or kind of padlock 99. It is also understood that while the exemplary padlock 99 is shown with a shackle 98 other locks and padlocks that include cables (not shown) and/or chains (not shown) as their securing mechanism may also be used with the present invention. Accordingly, it is understood that locks and padlocks 99 that may be used with the present invention may have securing mechanisms such as shackles 98, cables or chains.

Once the padlock 99 has been locked it is understood that the zippers 94 may not be separated since one of the zipper puller 95 is secured to the locking post 88 and the other zipper puller 95 is secured to the locking extension 59 by the shackle 98 of the padlock 99. In this manner, the anti-zipper sliding device 10 may prevent and/or inhibit unauthorized opening of the luggage 93 through use of the zippers 94, because the anti-zipper sliding device 10 prevents the zippers 94 from being separated from either other in order to cause opening of a part of the zipper track 89. Furthermore, through the action of the at least one gripping surface 73 molded, assembled and/or formed into either or both the upper body 30 and the lower body 40 the anti-zipper sliding device 10 is clamped onto the zipper track 89 thereby preventing either of the zippers 94 from sliding along the zipper track 89. Accordingly, it is understood that once the padlock 99 has been locked onto both the locking extension 59 and the zipper puller 95 that the zippers 94 may not be slid along the zipper track 89 since the anti-zipper sliding device 10 is clamped onto a particular location along the zipper track 89, and thereby preventing a breach at another part of the zipper track 89 from being closed. As a result, it is not possible to slide the zippers 94 back and forth along the zipper track 89 in order to reseal a gap in the zipper track 89 caused by an authorized and/or unpermitted breach of the zipper track 89, i.e. the zipper track 89 cannot be re-zipped without at least unlocking the padlock 99 from the zipper puller 95 and anti-zipper sliding device 10.

Furthermore, it is also understood that one of the zippers 94 may be positioned at one end of the zipper track 89 of luggage 93, and as a result the zipper 94 positioned at the end cannot be slid along the zipper track 89 because the zipper 94 has already been slid to an end. In this arrangement, it is not necessary that zipper puller 95 of the zipper 94 positioned at the end be hooked onto the locking post 88 as long as the other zipper puller 96 is hooked onto padlock shackle 98 which in turn is passed through hole 65 of the locking extension 59.

It is also understood that another advantage of the anti-zipper sliding device 10 according to the present invention is that in some types of luggage 93, there is only one zipper 94 which normally prevents the luggage 93 from being locked. In this arrangement, a user can completely close the zipper track 89, clamp the anti-zipper sliding device 10 externally onto the zipper track 89 directly, and then place the cover 20 on and hook a shackle 98 of the padlock 99 onto the hole 65 of the locking extension 59 and the zipper puller hole 96 together to restrict sliding movement from the zipper 94. By doing so, the zipper 94 is locked in position and it cannot be slid back and forth along the zipper track 89.

In order to disengage the anti-zipper sliding device 10 from the zipper track 89 after it is has been clamped onto the zipper track 89, the padlock 99 must be unlocked from the hole 65 of the locking extension 59 and the hole 97 of the zipper puller 95. Then the cover 20 is removed away from the upper body 30 of the anti-zipper sliding device 10 in order to expose the screw 77. The screw 77 may then be unscrewed so as to release the upper body 30 from the lower body 40, which thereby releases the at least one gripping surface 73 from the zipper track 89 of the luggage 93.

It is understood that the anti-zipper sliding device 10 and any of its components may be made from any suitable material in accordance with the desired durability, security and/or cost of manufacturing. For example, the anti-zipper sliding device 10 and any of its components may be made from any variety of plastics, metals, alloys, rubbers and/or urethanes. It is also understood that various components of the anti-zipper sliding device 10 may be made from different materials, and even the same component may be formed from a composite and/or combination of materials.

Figure 7:
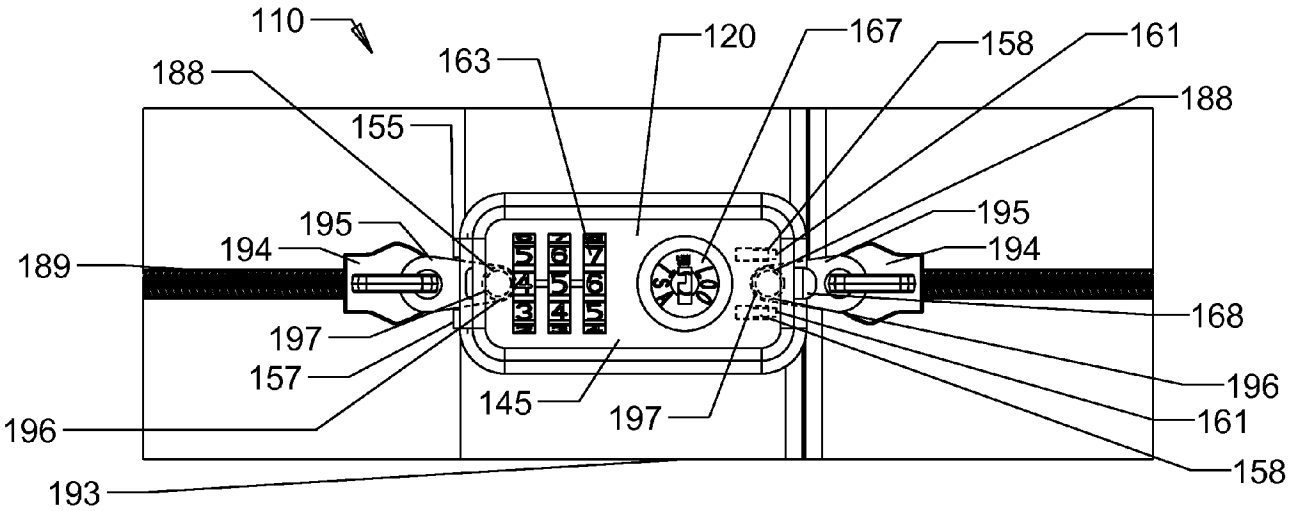
FIG. 7 is a top plan view of another exemplary embodiment of an anti-zipper sliding device according to the present invention attached around a luggage zipper so as to prevent unauthorized re-zipping of the luggage zipper if there has been a zipper breach.
Figure 8:
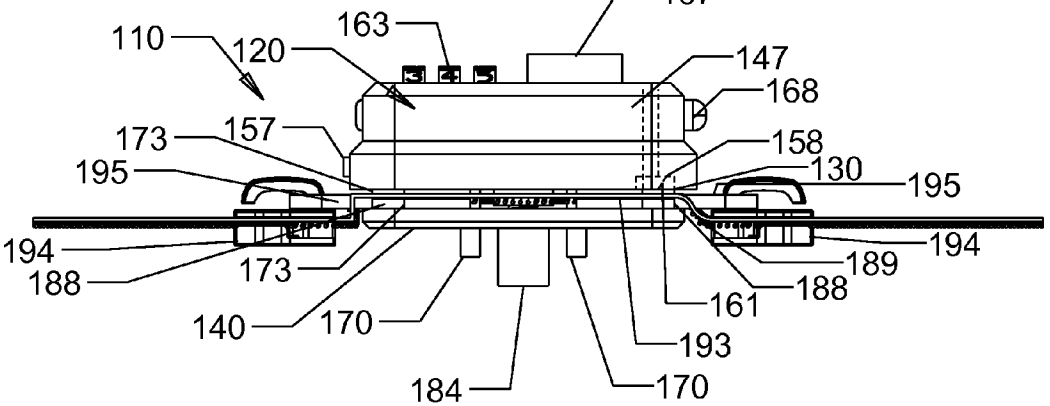
FIG. 8 is a side view of the other exemplary embodiment of the anti-zipper sliding device according to the present invention.
Figure 9:
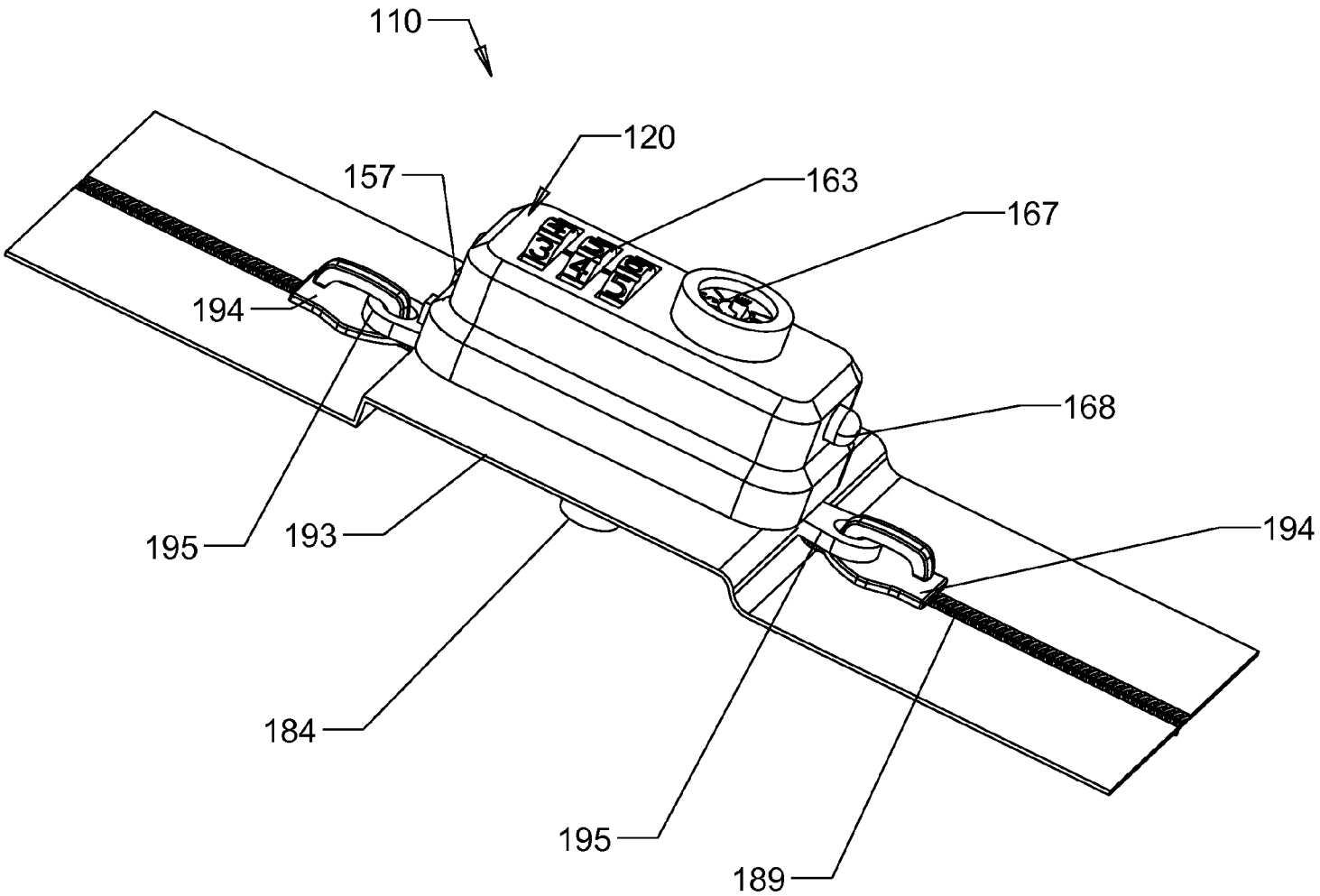
FIG. 9 is a perspective view of the other exemplary embodiment of the anti-zipper sliding device according to the present invention.
Figure 10A:
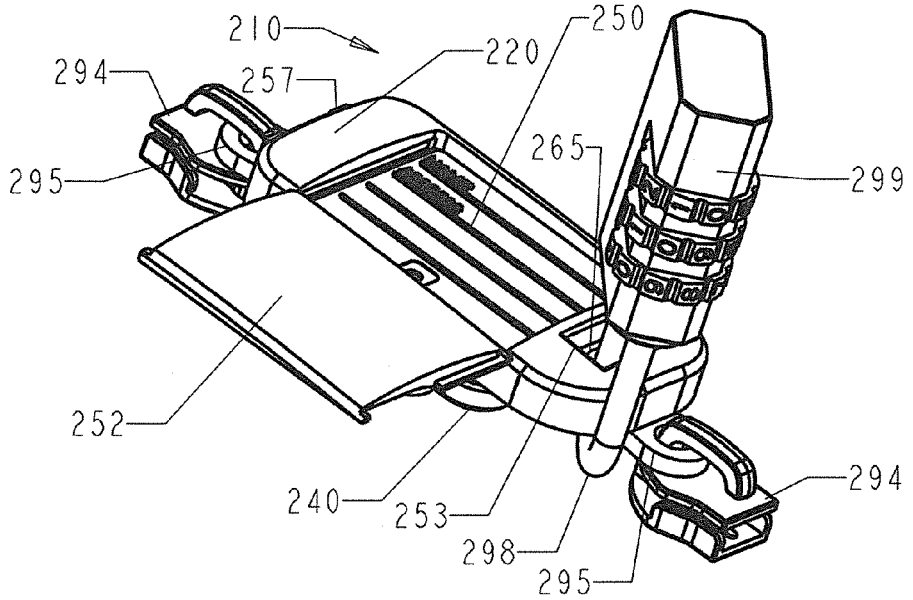
FIG. 10A is a top perspective view of another exemplary embodiment of the anti-zipper sliding device according to the present invention attached to zipper pullers.
Figure 10B:
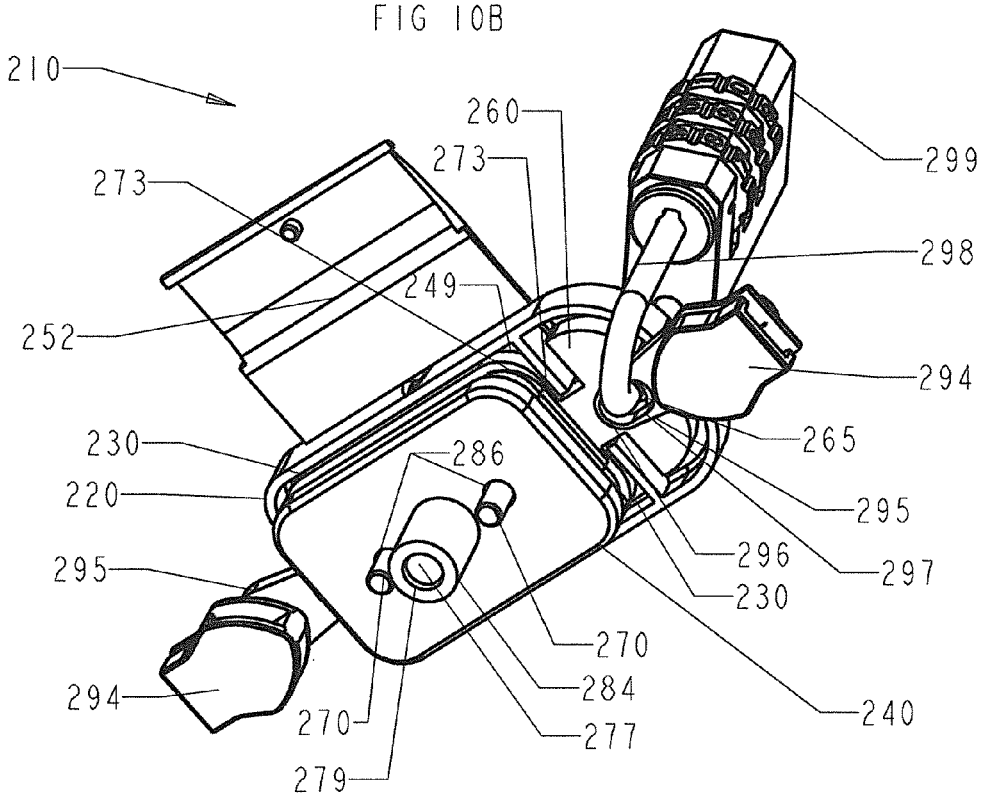
FIG. 10B is a bottom perspective view of the other exemplary embodiment of the anti-zipper sliding device according to the present invention attached to zipper pullers.
Figure 11:
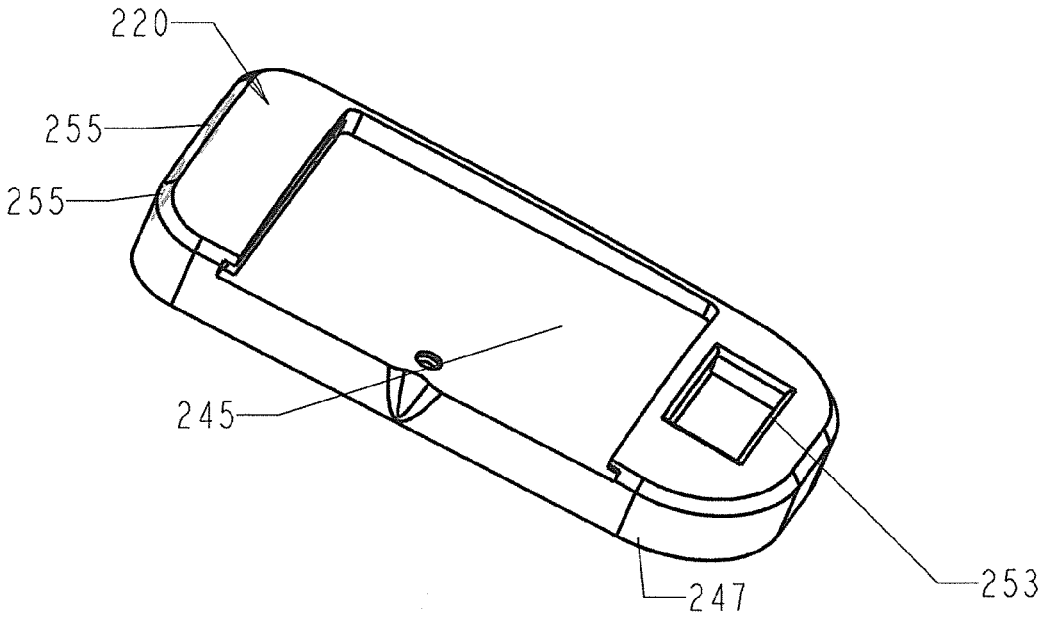
FIG. 11 is a perspective view of an exemplary embodiment of a cover that may be used with the other exemplary embodiment of the anti-zipper sliding device in accordance with the present invention.
Figure 12:
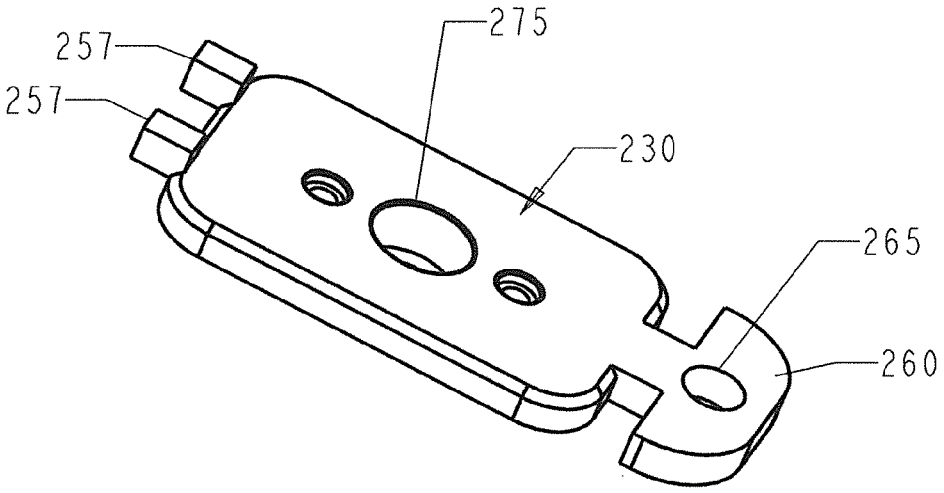
FIG. 12 is a perspective view of an exemplary embodiment of an upper body that may be used with the other exemplary embodiment of the anti-zipper sliding device in accordance with the present invention.

Referring now to FIGS. 7-9, in which another exemplary embodiment of an anti-zipper sliding device, generally indicated by reference numeral 110, according to the present invention is shown. The anti-zipper sliding device 110 includes a cover 120, an upper body 130 and a lower body 140. The upper body 130 and the lower body 140 are configured for releaseable engagement with each other, and the cover 120 is dimensioned to at least partially cover the upper body 130. It is understood that the use of the terms "upper" and "lower" to refer to the upper body 130 and the lower 140 are merely used to identify the body portions, and are not intended to limit the location, position and/or orientation of the upper body 130, lower body 140 and/or anti-zipper sliding device 110 in any particular manner. The cover 120 may include a body covering portion 145 that is configured to cover at least a portion of the upper body 130, and the cover 120 may also include a sidewall 147 surrounding at least a part of the perimeter of the body covering portion 145. The body covering portion 145 and the sidewall 147 may form a cavity (not shown) of the cover 120, in which the upper body 130 may be received. The cover 120 may also have at least one slot 155 formed in the sidewall 147 at an end of the cover 120.

Still referring to FIGS. 7-9, the upper body 130 of the anti-zipper sliding device 110 includes at least one projection 157 extending from one end of the upper body 130 that is configured to be receiving engaged with the at least one slot 155 of the cover 120. It is understood that the upper body 130 may include a number of the projections 157 to correspond to the number of slots 155 formed in the cover 120, for example two, but it is understood that the present invention is not limited to any particular number of projections 157 and/or slots 155. The upper body 130 also includes a locking slot 158 that is positioned so as to receive and/or retain a latch 161 of the cover 120 when the upper body 130 is engaged with the cover 120. The latch 161 is operatively connected to an internal locking mechanism of the anti-zipper sliding device 110 that may include a combination locking mechanism 163 and/or a key locking mechanism 167. Any suitable combination locking mechanism 163 and/or key locking mechanism 167 as understood by one of ordinary skill in the art may be used with the anti-zipper sliding device 110 according to the present invention, and it is understood that the present invention is not limited to any particular combination locking mechanism 163 and/or key locking mechanism 167. The internal components of these locking mechanisms and their functioning is understood to one of ordinary skill in the art. When the combination locking mechanism 163 and the key locking mechanism 167 are locked, it is understood that the latch 161 is engaged with the locking slot 158 in order to retain the cover 120 in engagement with the upper body 130. When either of the combination locking mechanism 163 or the key locking mechanism 167 are unlocked, it is understood that a button 168 may be actuated in order to release the latch 161 from the locking slot 158 in order to allow release of the cover 120 from the upper body 130. The upper body 130 may also include at least one alignment pin 170 extending from a surface of the upper body 130, and at least one post receiving chamber (not shown) formed in the same surface of the upper body 130 from which the at least one alignment pin 170 extends from. The upper body 130 may also include at least one gripping surface 173 formed on and/or from the same surface of the upper body 130 from which the at least one alignment pin 170 extends from. A screw hole (not shown) may also be formed in the upper body 130 in order to allow a screw (not shown), or other fastening device, to partially pass through the upper body 130. It is understood that the upper body 130 may be configured to receive and/or retain multiple fastening devices, such as multiple screws.

Still referring to FIGS. 7-9, the lower body 140 of the anti-zipper sliding device 110 may include at least one gripping surface 173 extending from and/or formed on a surface thereof that faces the at least one gripping surface 173 of the upper body 130 when the upper body 130 and the lower body 140 are fastened together. The lower body 140 may also include a threaded hole (not shown) that is configured to align with the screw hole (not shown) of the upper body 130 in order to engage with and receive threads (not shown) on the screw (not shown). It is understood that the lower body 140 may be configured so as to receive and/or retain multiple screws, or other fastening devices. Extending from a surface of the lower body 140 opposite the surface from which the at least one gripping surface 173 extends from is a screw protection ring 184 that extends around the threaded hole (not shown). The screw protection ring 184 is configured to protect the screw (not shown) from being unwound from the surface of the lower body 140 opposite the surface from which the at least one gripping surface 173 extends from. The lower body 140 may also include at least one hole (not shown) that is dimensioned and positioned within the lower body 140 to receive the at least one alignment pin 170 of the upper body 130. The lower body 140 also includes a pair of locking posts 188 extending from the lower body 140 on the same side of the lower body 140 as the at least one gripping surface 173, and dimensioned and positioned so as to be at least partially inserted into post receiving chambers (not shown) of the upper body 130.

The operation and use of the anti-zipper sliding device 110 according to this exemplary embodiment of the present invention will now be discussed with reference to FIGS. 7-9. The anti-zipper sliding device 110 may be installed on a zipper track 189 of a piece of luggage 193. The zipper track 189 on the luggage 193 may be separated, i.e. opened, and joined, i.e. closed by at least one zipper 194, and preferably the zipper track 189 includes two zippers 194. Each zipper 194 has a zipper puller 195 that includes a loop 196 that may define a hole 197 of the zipper puller 195. In order to install the anti-zipper sliding device 110 on the zipper track 189 so that movement of the zippers 194 is restricted and/or prevented, the lower body 140 is placed within the luggage 193 and then the locking posts 188 are placed into the holes 197 of the zipper pullers 195. In order to install the anti-zipper sliding device 110 on the luggage 193, the zipper pullers 195 are operated such that the zippers 194 are moved away from each other in order to allow the lower body 140 to be placed underneath the zipper track 189 of the luggage 193. The upper body 130 is then positioned on the outside of the luggage 193 and engaged with the lower body 140 by aligning the at least one alignment pin 170 with the corresponding at least one hole (not shown) and inserting the locking posts 188 at least partially into the post receiving chambers (not shown). The screw (not shown), or other fastening mechanism, may then be inserted through the screw hole (not shown) of the upper body 130 in order to threadenly engage with the threaded hole (not shown) of the lower body 140. The screw is then tightened in order to secure the upper body 130 to the lower body 140, and thereby secure both the upper body 130 and the lower boy 140 to a particular position on the zipper track 189 of the luggage 193.

Still referring to FIGS. 7-9, once the upper body 130 and lower body 140 have been secured to the zipper track 189, the cover 120 may be installed on the upper body 130 by placing the at least one projection 157 through the corresponding at least one slot 155 on the cover and engaging the locking slot 158 with the latch 161. The at least one projection 157 prevents pushing the cover 20 off of the anti-zipper sliding device 110 when the anti-zipper sliding device 110 has been locked and clamped onto the luggage 193. The shape of the at least one slot 155 and the at least one projection 157 do not matter; as long as this function is performed. In this manner, the screw (not shown) is covered by the cover 120, and therefore can only be accessed by removal of the cover 120. In order to further secure the cover 120 to the upper body 130, and the anti-zipper sliding device 110 to the zipper track 189 the combination locking mechanism 163 and the key locking mechanism 167 are locked in order to prevent the latch 161 from being disengaged from the locking slot 158 when the button 168 is actuated. Once the combination locking mechanism 163 and the key locking mechanism 167 have been locked it is understood that the zippers 194 may not be separated since the zipper pullers 195 are secured to the locking posts 188. In this manner, the anti-zipper sliding device 110 may prevent and/or inhibit unauthorized opening of the luggage 193 through use of the zippers 194, because the anti-zipper sliding device 110 prevents the zippers 194 from being separated from either other in order to cause opening of a part of the zipper track 189. Furthermore, through the action of the at least one gripping surface 173 molded, assembled and/or formed into either or both the upper body 130 and the lower body 140 the anti-zipper sliding device 110 is clamped onto the zipper track 189 thereby preventing either of the zippers 194 from sliding along the zipper track 189. Accordingly, it is understood that the zippers 194 may not be slid along the zipper track 189 since the anti-zipper sliding device 110 is clamped onto a particular location along the zipper track 189, and thereby preventing a breach at another part of the zipper track 189 from being closed. As a result, it is not possible to slide the zippers 194 back and forth along the zipper track 189 in order to reseal a gap in the zipper track 189 caused by an authorized and/or unpermitted breach of the zipper track 189, i.e. the zipper track 189 cannot be re-zipped without unlocking either of the combination locking mechanism 163 of the key locking mechanism 167 in order to release at least one of the zipper pullers 195 from the anti-zipper sliding device 110.

Furthermore, it is also understood that one of the zippers 194 may be positioned at one end of the zipper track 189 of luggage 193, and as a result the zipper 194 positioned at the end cannot be slid along the zipper track 189 because the zipper 194 has already been slid to an end. In this arrangement, it is not necessary that zipper puller 195 of the zipper 194 positioned at the end be hooked onto one of the locking posts 188 as long as the other zipper puller 196 is hooked onto one of the locking posts 188.

It is also understood that another advantage of the anti-zipper sliding device 110 according to the present invention is that in some types of luggage 193, there is only one zipper 194 which normally prevents the luggage 193 from being locked. In this arrangement, a user can completely close the zipper track 189, clamp the anti-zipper sliding device 110 externally onto the zipper track 189 directly, and then place the cover 120 on the upper body 130 in order to lock the anti-zipper sliding device 110 and to restrict sliding movement from the zipper 194. By doing so, the zipper 194 is locked in position and it cannot be slid back and forth along the zipper track 189.

In order to disengage the anti-zipper sliding device 110 from the zipper track 189 after it is has been clamped onto the zipper track 189, either the combination locking mechanism 163 or the key locking mechanism 167 are unlocked, the button 168 may then be actuated in order to disengage the latch 161 from the locking slot 158. Then the cover 120 is removed away from the upper body 130 of the anti-zipper sliding device 110 in order to expose the screw (not shown). The screw may then be unscrewed so as to release the upper body 130 from the lower body 140, which thereby releases the at least one gripping surface 173 from the zipper track 189 of the luggage 193.

It is understood that the anti-zipper sliding device 110 and any of its components may be made from any suitable material in accordance with the desired durability, security and/or cost of manufacturing. For example, the anti-zipper sliding device 110 and any of its components may be made from any variety of plastics, metals, alloys, rubbers and/or urethanes. It is also understood that various components of the anti-zipper sliding device 110 may be made from different materials, and even the same component may be formed from a composite and/or combination of materials. Referring now to FIGS. 10A, 10B and 11-12, in which another exemplary embodiment of an anti-zipper sliding device, generally indicated by reference numeral 210, according to the present invention is shown. The anti-zipper sliding device 210 includes a cover 220, an upper body 230 and a lower body 240. The upper body 230 and the lower body 240 are configured for releaseable engagement with each other, and the cover 220 is dimensioned to at least partially cover the upper body 230. It is understood that the use of the terms "upper" and "lower" to refer to the upper body 230 and the lower 240 are merely used to identify the body portions, and are not intended to limit the location, position and/or orientation of the upper body 230, lower body 240 and/or anti-zipper sliding device 210 in any particular manner. The cover 220 may include a body covering portion 245 that is configured to cover at least a portion of the upper body 230, and the cover 220 may also include a sidewall 247 surrounding at least a part of the perimeter of the body covering portion 245. The body covering portion 245 and the sidewall 247 may form a cavity 249 of the cover 220, in which the upper body 230 may be received. The cover 220 may also include an address tag 250 and an address tag cover 252 which are formed and/or placed on the body covering portion 250 of the cover 220. The cover 220 may also include an a hole 253 formed therein, and the cover 220 may also have at least one slot 255 formed in the sidewall 247 at an end of the cover 220.

Still referring to FIGS. 10A, 10B and 11-12, the upper body 230 of the anti-zipper sliding device 210 includes at least one projection 257 extending from one end of the upper body 230 that is configured to be receiving engaged with the at least one slot 255 of the cover 220. It is understood that the upper body 230 may include a number of the projections 257 to correspond to the number of slots 255 formed in the cover 220, for example two, but it is understood that the present invention is not limited to any particular number of projections 257 and/or slots 255. The upper body 230 may also include an extension 260 extending from an end of the upper body 230 opposite the at least one projection 257. The extension 260 may be positioned substantially perpendicular to the upper body 230, and may include a hole 265 formed therein. The upper body 230 may also include at least one alignment pin 270 extending from a surface of the upper body 230, and a post receiving chamber (not shown) formed in the same surface of the upper body 230 from which the at least one alignment pin 270 extends from. The upper body 230 may also include at least one gripping surface 273 formed on and/or from the same surface of the upper body 230 from which the at least one alignment pin 270 extends from. A screw hole 275 may also be formed in the upper body 30 in order to allow a screw 277, or other fastening device, to partially pass through the upper body 230. It is understood that the upper body 230 may be configured to receive and/or retain multiple fastening devices, such as multiple screws 277.

Still referring to FIGS. 10A, 10B and 11-12, the lower body 240 of the anti-zipper sliding device 210 may include at least one gripping surface 273 extending from and/or formed on a surface thereof that faces the at least one gripping surface 273 of the upper body 230 when the upper body 230 and the lower body 240 are fastened together. The lower body 240 may also include a threaded hole 279 that is configured to align with the screw hole 275 of the upper body 230 in order to engage with and receive threads (not shown) on the screw 277. It is understood that the lower body 240 may be configured so as to receive and/or retain multiple screws 277, or other fastening devices. Extending from a surface of the lower body 240 opposite the surface from which the at least one gripping surface 273 extends from is a screw protection ring 284 that extends around the threaded hole 279. The screw protection ring 284 is configured to protect the screw 277 from being unwound from the surface of the lower body 240 opposite the surface from which the at least one gripping surface 273 extends from. The lower body 240 may also include at least one hole 286 that is dimensioned and positioned within the lower body 240 to receive the at least one alignment pin 270 of the upper body 230. The lower body 240 also includes a locking post (not shown) extending from the lower body 240 on the same side of the lower body 240 as the at least one gripping surface 273, and dimensioned and positioned so as to be at least partially inserted into the post receiving chamber (not shown) of the upper body 230.

The operation and use of the anti-zipper sliding device 210 according to this exemplary embodiment of the present invention will now be discussed with reference to FIGS. 10A, 10B and 11-12. The anti-zipper sliding device 210 may be installed on a zipper track (not shown) of a piece of luggage (not shown). The zipper track on the luggage may be separated, i.e. opened, and joined, i.e. closed by at least one zipper 294, and preferably the zipper track includes two zippers 294. Each zipper 294 has a zipper puller 295 that includes a loop 296 that may define a hole 297 of the zipper puller 295. In order to install the anti-zipper sliding device 210 on the zipper track (not shown) so that movement of the zippers 294 is restricted and/or prevented, the lower body 240 is placed within the luggage (not shown) and then the locking post 288 is placed into the hole 297 of one of the zipper pullers 295. In order to install the anti-zipper sliding device 210 on the luggage, the zipper pullers 295 are operated such that the zippers 294 are moved away from each other in order to allow the lower body 240 to be placed underneath the zipper track of the luggage. The upper body 230 is then positioned on the outside of the luggage 293 and engaged with the lower body 240 by aligning the at least one alignment pin 270 with the corresponding at least one hole 286 and inserting the locking post (not shown) at least partially into the post receiving chamber (not shown). The screw 277, or other fastening mechanism, may then be inserted through the screw hole 275 of the upper body 30 in order to threadenly engage with the threaded hole 279 of the lower body 40. The screw 277 is then tightened in order to secure the upper body 230 to the lower body 240, and thereby secure both the upper body 230 and the lower boy 240 to a particular position on the zipper track (not shown) of the luggage (not shown).

Still referring to FIGS. 10A, 10B and 11-12, once the upper body 230 and lower body 240 have been secured to the zipper track (not shown), the cover 220 may be installed on the upper body 230 by placing the at least one projection 257 through the corresponding at least one slot 255, and positioning the upper body 230 into the cavity 249. The at least one projection 257 prevents pushing the cover 220 off of the anti-zipper sliding device 210 when the anti-zipper sliding device 210 has been locked and clamped onto the luggage (not shown). The shape of the at least one slot 255 and the at least one projection 257 do not matter; as long as this function is performed. In this manner, the screw 277 is covered by the cover 220, and therefore can only be accessed by removal of the cover 220. In order to further secure the cover 220 to the upper body 230, and the anti-zipper sliding device 210 to the zipper track (not shown) a shackle 298 of a padlock 299 may be placed through the hole 265 in the extension 260 and the hole 297 of the other zipper puller 295. It is understood that the padlock 299 may be any padlock known to one of ordinary skill in the relevant art, and while a combination locking mechanism type padlock 299 is shown it is understood that any locking mechanism or combination of locking mechanisms, for example a tool locking mechanism, i.e. operated by a tool such as a key, or combination locking mechanism requiring input of a particular combination for operation may be used with the present invention, as the present invention is not limited to any particular type or kind of padlock 299. It is also understood that while the exemplary padlock 299 is shown with a shackle 298 other locks and padlocks that include cables (not shown) and/or chains (not shown) as their securing mechanism may also be used with the present invention. Accordingly, it is understood that locks and padlocks 299 that may be used with the present invention may have securing mechanisms such as shackles 298, cables or chains.

Once the padlock 299 has been locked it is understood that the zippers 294 may not be separated since one of the zipper puller 295 is secured to the locking post (not shown) and the other zipper puller 295 is secured to the extension 260 by the shackle 298 of the padlock 299. In this manner, the anti-zipper sliding device 210 may prevent and/or inhibit unauthorized opening of the luggage (not shown) through use of the zippers 294, because the anti-zipper sliding device 210 prevents the zippers 294 from being separated from either other in order to cause opening of a part of the zipper track (not shown). Furthermore, through the action of the at least one gripping surface 273 molded, assembled and/or formed into either or both the upper body 230 and the lower body 240 the anti-zipper sliding device 210 is clamped onto the zipper track (not shown) thereby preventing either of the zippers 294 from sliding along the zipper track. Accordingly, it is understood that once the padlock 299 has been locked onto both the extension 260 and the zipper puller 295 that the zippers 294 may not be slid along the zipper track (not shown) since the anti-zipper sliding device 210 is clamped onto a particular location along the zipper track, and thereby preventing a breach at another part of the zipper track from being closed. As a result, it is not possible to slide the zippers 294 back and forth along the zipper track (not shown) in order to reseal a gap in the zipper track caused by an authorized and/or unpermitted breach of the zipper track, i.e. the zipper track cannot be re-zipped without at least unlocking the padlock 299 from the zipper puller 295 and anti-zipper sliding device 210.

Furthermore, it is also understood that one of the zippers 294 may be positioned at one end of the zipper track (not shown) of luggage (not shown), and as a result the zipper 294 positioned at the end cannot be slid along the zipper track because the zipper 294 has already been slid to an end. In this arrangement, it is not necessary that zipper puller 295 of the zipper 294 positioned at the end be hooked onto the locking post (not shown) as long as the other zipper puller 296 is hooked onto padlock shackle 298 which in turn is passed through hole 265 of the extension 260 and the hole 253 of the cover 220.

It is also understood that another advantage of the anti-zipper sliding device 210 according to the present invention is that in some types of luggage, there is only one zipper 294 which normally prevents the luggage (not shown) from being locked. In this arrangement, a user can completely close the zipper track (not shown), clamp the anti-zipper sliding device 210 externally onto the zipper track directly, and then place the cover 220 on and hook a shackle 298 of the padlock 299 onto the hole 265 of the extension 260 and the zipper puller hole 296 together to restrict sliding movement from the zipper 294. By doing so, the zipper 294 is locked in position and it cannot be slid back and forth along the zipper track.

In order to disengage the anti-zipper sliding device 210 from the zipper track after it is has been clamped onto the zipper track, the padlock 299 must be unlocked from the hole 265 of the extension 260, the hole 253 of the cover 220 and the hole 297 of the zipper puller 295. Then the cover 220 is removed away from the upper body 230 of the anti-zipper sliding device 210 in order to expose the screw 277. The screw 277 may then be unscrewed so as to release the upper body 230 from the lower body 240, which thereby releases the at least one gripping surface 273 from the zipper track (not shown) of the luggage (not shown).

It is understood that the anti-zipper sliding device 210 and any of its components may be made from any suitable material in accordance with the desired durability, security and/or cost of manufacturing. For example, the anti-zipper sliding device 210 and any of its components may be made from any variety of plastics, metals, alloys, rubbers and/or urethanes. It is also understood that various components of the anti-zipper sliding device 210 may be made from different materials, and even the same component may be formed from a composite and/or combination of materials.

It will thus be seen that the objects set forth above, among those made apparent from the preceding description, are efficiently attained and, since certain changes may be made in the above article without departing from the scope of this invention, it is intended that all matter contained in this disclosure or shown in the accompanying drawings, shall be interpreted, as illustrative and not in a limiting sense. It is to be understood that all of the present figures, and the accompanying narrative discussions of corresponding embodiments, do not purport to be completely rigorous treatments of the invention under consideration. It is to be understood that the above-described arrangements are only illustrative of the application of the principles of the present invention. Numerous modifications and alternative arrangements may be devised by those skilled in the art without departing from the scope of the present invention.

What is claimed is:

1. An anti-zipper sliding device, comprising:

a first body portion and a second body portion configured for removable attachment to each other by a fastener;

at least one gripping surface positioned on at least one of the first body portion or the second body portion; and a cover configured to cover at least a part of the first body portion and at least a part of the fastener;

wherein the first body portion and the second body portion are configured for attachment to a piece of luggage having a zipper track with at least one zipper so as to prevent movement of the anti-zipper sliding device along the zipper track of the luggage;

wherein the cover is further configured to be secured to the first body portion by a locking mechanism when the cover covers at least a part of the first body portion; and wherein the first body portion comprises a fastener hole configured to receive the fastener to allow the fastener to pass through the first body portion, and wherein the second body portion comprises a threaded hole configured for alignment with the fastener hole and configured to threadenly engage with the fastener in order to secure the first body portion to the second body portion.

2. The anti-zipper sliding device according to claim 1, further comprising the fastener, and wherein the fastener is configured to position the anti-zipper sliding device between a clamped mode in which movement of the anti-zipper sliding device along the zipper track of the luggage is prevented, and a separated mode in which the anti-zipper sliding device is disengaged from the luggage or slidable along the zipper track of the luggage.

3. The anti-zipper sliding device according to claim 2, wherein when the anti-zipper sliding device is in the clamped mode the at least one gripping surface is engaged with at least a portion of the zipper track, and the at least one gripping surface and the zipper track are positioned between the first body portion and the second body portion.

4. The anti-zipper sliding device according to claim 2, further comprising at least one locking post extending from the second body portion, and at least one post receiving chamber formed in the first body portion, wherein each of the at least one post receiving chambers are positioned in the first body portion to at least partially receive one of the at least one locking post when the anti-zipper sliding device is in the clamped mode.

5. The anti-zipper sliding device according to claim 4, wherein when the at least one locking post is received within one of the at least one post receiving chambers, the at least one locking post is configured to secure to one of the at least one zippers of the zipper track so that when the anti-zipper sliding device is in the clamped mode movement of the zipper relative to the anti-zipper sliding device is restricted.

6. The anti-zipper sliding device according to claim 2, wherein the threaded hole is configured for alignment with the fastener hole when the anti-zipper sliding device is in the clamped mode.

7. The anti-zipper sliding device according to claim 2, wherein at least one gripping surface is positioned on the first body portion and at least one gripping surface is positioned on the second body portion so that each of the at least one gripping surfaces substantially face each and are engaged with the zipper track when the anti-zipper sliding device is in the clamped mode.

8. The anti-zipper sliding device according to claim 2, wherein the first body portion comprises a locking extension and a hole formed therein, and wherein the cover comprises an extended tab and a tab hole formed therein and dimensioned to receive the locking extension of the first body portion when the cover covers at least a part of the first body portion.

9. The anti-zipper sliding device according to claim 8, wherein the locking mechanism is a padlock having a securing mechanism, and wherein the padlock is configured to secure the locking extension to one of the at least one zippers by passing the securing mechanism through the hole formed in the locking extension and the zipper so that when the anti-zipper sliding device is in the clamped mode movement of the zipper relative to the anti-zipper sliding device is restricted.

10. The anti-zipper sliding device according to claim 9, wherein when the securing mechanism of the padlock is locked onto the locking extension the cover is secured to the first body portion.

11. The anti-zipper sliding device according to claim 9, wherein the securing mechanism is selected from one of a shackle, a cable or a chain.

12. The anti-zipper sliding device according to claim 2, wherein the locking mechanism comprises a combination locking mechanism operable between a locked configuration and an unlocked configuration, and wherein the cover is releasable from the first body portion when the combination locking mechanism is in the unlocked configuration.

13. The anti-zipper sliding device according to claim 12, wherein the locking mechanism further comprises a key locking mechanism operable between a locked orientation and an unlocked orientation, and wherein the cover is releasable from the first body portion when the key locking mechanism is in the unlocked orientation.

14. The anti-zipper sliding device according to claim 12, further comprising a pair of locking posts extending from the second body portion and positioned at opposite ends of the second body portions, and a pair of post receiving chambers formed in the first body portion, wherein each the pair of post receiving chambers are positioned in the first body portion to at least partially receive one of the pair of locking posts when the anti-zipper sliding device is in the clamped mode.

15. The anti-zipper sliding device according to claim 2, wherein the first body portion comprises an extension and a hole formed therein, and wherein the cover comprises a shackle hole formed therein and positioned for alignment with the hole when the cover covers at least a part of the first body portion.

16. The anti-zipper sliding device according to claim 15, wherein the locking mechanism is a padlock having a securing mechanism, and wherein the padlock is configured to secure the extension to one of the at least one zippers by passing the securing mechanism through the hole formed in the locking extension and the zipper so that when the anti-zipper sliding device is in the clamped mode movement of the zipper relative to the anti-zipper sliding device is restricted.

17. The anti-zipper sliding device according to claim 16, wherein when the securing mechanism of the padlock is locked onto the extension the cover is secured to the first body portion.

18. The anti-zipper sliding device according to claim 16, wherein the securing mechanism is selected from one of a shackle, a cable or a chain.

19. The anti-zipper sliding device according to claim 2, wherein the second body portion comprises a protection ring extending from a surface of the second body opposite a surface from which the at least one gripping member extends from, and wherein the protection ring is configured to protect the fastener from being released from the ant-zipper sliding device when the anti-zipper sliding device is in the clamped mode.

20. The anti-zipper sliding device according to claim 1, further comprising at least one projection extending from the first body portion, and at least one slot formed in the cover and each of the at least one slot are positioned to receive one of the at least one projection when the cover covers at least a part of the first body portion.

* * * * *